US011071677B1

(12) United States Patent
Burns et al.

(10) Patent No.: US 11,071,677 B1
(45) Date of Patent: Jul. 27, 2021

(54) BODYWEIGHT UNLOADING LOCOMOTIVE DEVICE

(71) Applicants: Richard S. Burns, Phoenix, AZ (US); Andrew J. D. Burns, Bend, OR (US)

(72) Inventors: Richard S. Burns, Phoenix, AZ (US); Andrew J. D. Burns, Bend, OR (US)

( * ) Notice: Subject to any disclaimer, the term of this patent is extended or adjusted under 35 U.S.C. 154(b) by 0 days.

(21) Appl. No.: 17/160,221

(22) Filed: Jan. 27, 2021

Related U.S. Application Data

(60) Provisional application No. 62/967,011, filed on Jan. 28, 2020.

(51) Int. Cl.
*A61H 3/04* (2006.01)
*A61H 3/00* (2006.01)

(52) U.S. Cl.
CPC ..... *A61H 3/04* (2013.01); *A61H 2003/007* (2013.01); *A61H 2201/1418* (2013.01); *A61H 2201/1652* (2013.01)

(58) Field of Classification Search
CPC ..... A61H 3/04; A61H 2201/1418; A61H 2201/1652; A61H 2003/007
See application file for complete search history.

(56) References Cited

U.S. PATENT DOCUMENTS 1,611,807 A 12/1926 Martha
2,210,269 A * 8/1940 Taylor ..... A61H 3/04 601/33
2,327,671 A 8/1943 Rupprecht
3,252,704 A * 5/1966 Wilson ..... A61G 7/1017 482/68
3,721,437 A 3/1973 Skaricic
3,778,052 A 12/1973 Andow et al.
4,211,426 A * 7/1980 Motloch ..... A47D 13/04 280/87.041
5,174,590 A 12/1992 Kerley et al.
5,275,426 A * 1/1994 Tankersley ..... A61H 3/008 135/67
6,935,353 B2 8/2005 Hawkes et al.
7,294,094 B1 11/2007 Howle
9,452,102 B2 9/2016 Ledea
9,895,282 B2 * 2/2018 Butters ..... A61H 3/04
10,080,700 B1 9/2018 Bagheri
10,493,309 B2 * 12/2019 Jue ..... A63B 22/02
10,500,122 B2 * 12/2019 Aryananda ..... A61H 3/04
2001/0048206 A1 12/2001 Niu et al.
2004/0002407 A1 1/2004 Hawkes et al.
2005/0183759 A1 8/2005 Wolfe
(Continued)

*Primary Examiner* — Noah Chandler Hawk
(74) *Attorney, Agent, or Firm* — Thomas W. Galvani, P.C.; Thomas W. Galvani

(57) ABSTRACT

A bodyweight unloading locomotive device includes a frame mounted on wheels for locomotive movement. The frame has opposed left and right sides and a harness for supporting a user between the left and right sides. An unloading assembly is carried on each of the left and right sides, wherein the unloading assemblies each includes a sprung arm having a fixed end fixed to the respective left and right side, and an opposed free end. The assemblies further each include a cam assembly mounted on the free end of the sprung arm and a tether routed through the cam assembly and extending to the harness. Each of the unloading assemblies exerts an independent unloading force on the harness with respect to the frame.

20 Claims, 8 Drawing Sheets

(56) References Cited

U.S. PATENT DOCUMENTS

| | | | | |
|---|---|---|---|---|
| 2009/0298653 | A1* | 12/2009 | Rodetsky ..... | A61H 1/0262<br>482/69 |
| 2013/0341891 | A1 | 12/2013 | Brewin et al. | |

* cited by examiner

BODYWEIGHT UNLOADING LOCOMOTIVE DEVICE

CROSS-REFERENCE TO RELATED APPLICATIONS

This application claims the benefit of U.S. Provisional Application No. 62/967,011, filed Jan. 28, 2020, which is hereby incorporated by reference.

FIELD

The present specification relates generally to locomotive equipment, and more particularly to locomotive rehabilitation, therapy, and training equipment.

BACKGROUND

Locomotion is a basic facet of human life. Mobility can, however, be difficult, injurious, or impossible for some. There are a variety of reasons for why a person may experience partial or complete mobility limitations: orthopedic conditions, neurological disorders, motor deconditioning, accident, injury, disease, and disability, for example. Continuing to move—or even attempting to move—can cause discomfort or injury.

Others may be injured or overweight but require exercise to become healthier. Some rehabilitation facilities have elaborate systems to partially support the weight of such patients, so that they may exercise toward health. The patients wear harnesses that are tethered to trolleys which ride in tracks in the ceiling. Such systems are complex, require assistance from a physical therapist, and are very expensive and thus limited in availability to the patient. Some of these systems provide a lifting force by spring, which changes as the user moves and displaces the spring. Others have sophisticated sensing technology which monitors movement of the patient and then adjusts the lifting force so as to provide a constant unweighting of the patient.

In some cases, movement may be possible and, indeed, easy, but the individual nonetheless wishes to lower his risk of injury from such movement. Athletes, for instance, often have a need to train long hours with great intensity. They balance the benefits of high-volume training against the elevated risk of injury. A competitive athlete can, after all, suffer serious physical and mental setbacks from even a mild injury. There are a variety of assistive devices to reduce the likelihood of injury during exercise. For example, runners may use buoyancy devices and run in the water. Or they may run on treadmills while zipped into a pressurized bag that lifts them slightly off the treadmill deck, thereby reducing foot-strike impact.

Physical therapists often have other devices which suspend from above to support the user while he or she moves. For example, devices exist which can be placed over or above a treadmill, usually with harnesses, hooks, or special clothing that partially lifts the patient while walking or running on a treadmill. These devices apply an upward force on a patient to reduce his impact while moving.

Of course, all of these solutions lack freedom of movement. The user is confined to a pool, a treadmill, or a pre-defined path set in ceiling tracks. The person cannot use any of these to walk to the bathroom or around the neighborhood, for example.

Further, and more seriously, each alters the normal pattern of motion during walking and running. Harnesses that hang from the ceiling tracks generally support the user at a single location, usually above the head or near the center of the back. Occasionally they lift the user at opposed sides of the hips. In both arrangements, the harness restricts the normal movement of the upper body during locomotion. The user may experience upward lift on one side of his body that is the same as that on the other side of this body. In other words, the user's left and right sides are lifted equally and simultaneously. In normal walking and running, however, the forces along the left side of the body are different than and independent from those along the right side of the body. Such systems do not account for these differences, and may exercise different muscles than those used in normal running and walking, thereby leading to improper or prolonged rehabilitation, therapy, or training.

Moreover, these systems may exercise different muscles than those used in normal walking and running, thereby leading to improper or prolonged rehabilitation, therapy, or training. The use of these devices in rehabilitation, therapy, or training fails to mimic real-life movement and may lead to improper recovery. An improved solution is needed.

SUMMARY

In an embodiment, a bodyweight unloading locomotive device includes a frame mounted on wheels for locomotive movement. The frame has opposed left and right sides, and a harness supports a user between those left and right sides. An unloading assembly is carried on each of the left and right sides, wherein the unloading assemblies each includes a sprung arm having a fixed end fixed to the respective left and right side, and an opposed free end. The assemblies further each include a cam assembly mounted on the free end of the sprung arm and a tether routed through the cam assembly and extending to the harness. Each of the unloading assemblies thereby exerts an independent unloading force on the harness with respect to the frame, encouraging natural movement and allowing independent unloading of the left and right sides of the body during such natural movement.

In another embodiment, a bodyweight unloading locomotive device includes a frame for supporting locomotive movement. The frame has opposed left and right sides, and a harness supports a user between those left and right sides. An unloading assembly is carried on each of the left and right sides. The unloading assemblies each include a spring having a first end fixed to the respective left and right side, and an opposed second end, a cam assembly, and a tether routed through the cam assembly and extending to the harness. A cable is routed through the cam assembly and extends to one of an anchor on the frame and the second end of the spring. Each of the unloading assemblies exerts an independent unloading force on the harness with respect to the frame.

The above provides the reader with a very brief summary of some embodiments described below. Simplifications and omissions are made, and the summary is not intended to limit or define in any way the disclosure. Rather, this brief summary merely introduces the reader to some aspects of some embodiments in preparation for the detailed description that follows.

BRIEF DESCRIPTION OF THE DRAWINGS

Referring to the drawings.

DETAILED DESCRIPTION

Figure 1:
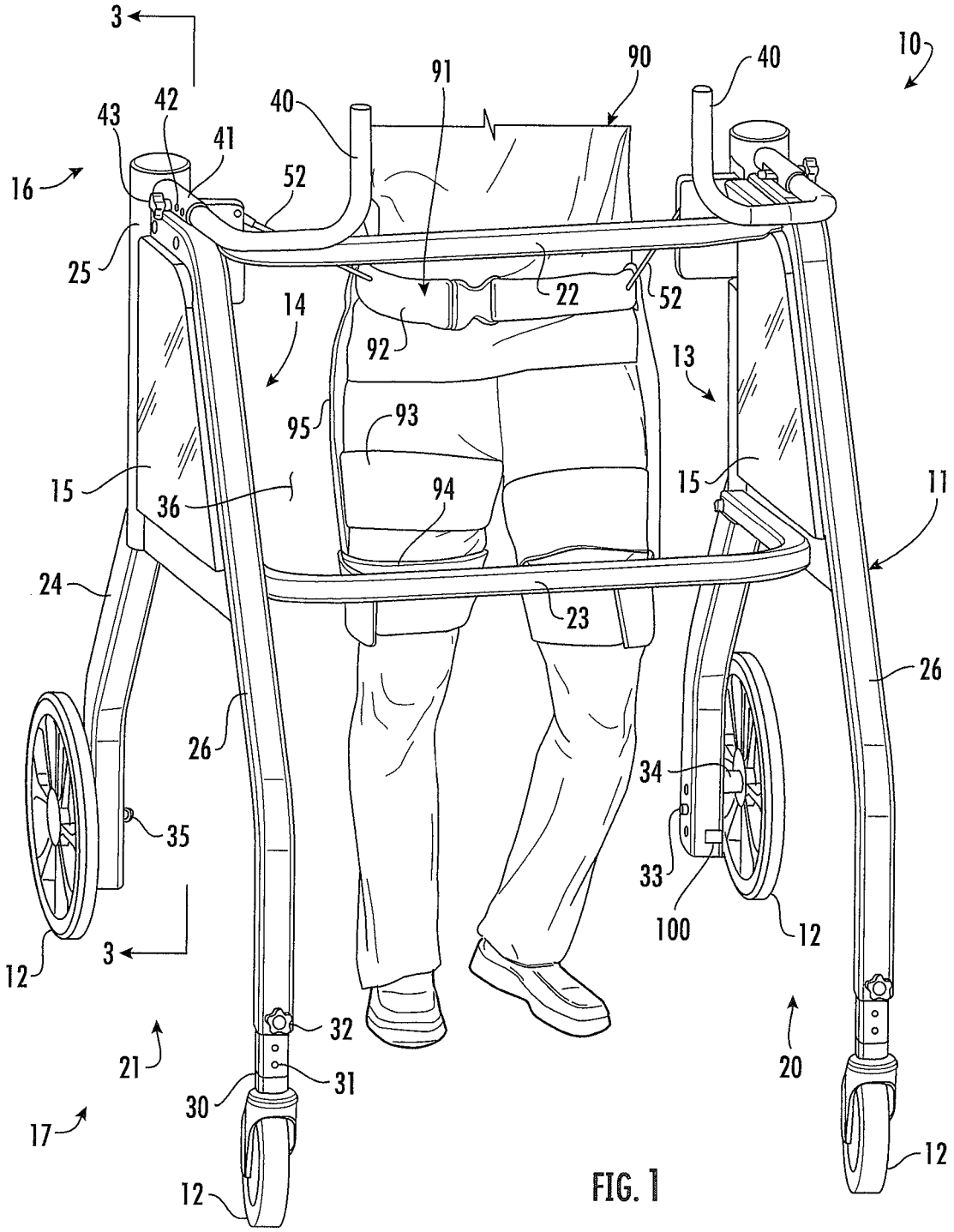
FIGS. 1 and 2 are front perspective and side elevation views of a bodyweight unloading locomotive device, respectively.

Reference now is made to the drawings, in which the same reference characters are used throughout the different figures to designate the same elements. Briefly, the embodiments presented herein are preferred exemplary embodiments and are not intended to limit the scope, applicability, or configuration of all possible embodiments, but rather to provide an enabling description for all possible embodiments within the scope and spirit of the specification. Description of these preferred embodiments is generally made with the use of verbs such as "is" and "are" rather than "may," "could," "includes," "comprises," and the like, because the description is made with reference to the drawings presented. One having ordinary skill in the art will understand that changes may be made in the structure, arrangement, number, and function of elements and features without departing from the scope and spirit of the specification. Further, the description may omit certain information which is readily known to one having ordinary skill in the art to prevent crowding the description with detail which is not necessary for enablement. Indeed, the diction used herein is meant to be readable and informational rather than to delineate and limit the specification; therefore, the scope and spirit of the specification should not be limited by the following description and its language choices.

Figure 2:
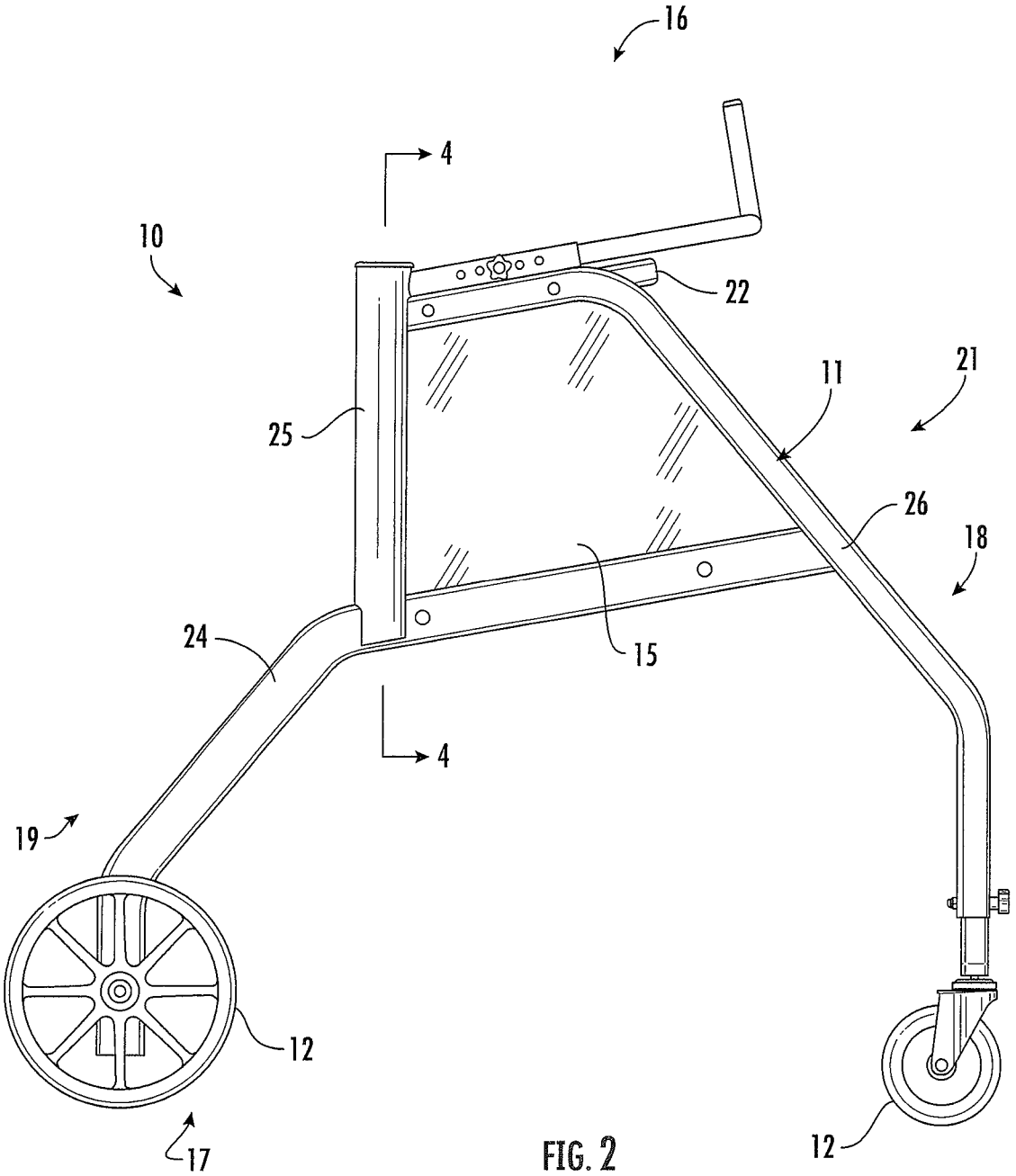

FIGS. 1 and 2 are front perspective and right side elevation views of a bodyweight unloading locomotive device 10 (hereinafter, the "device 10") for support during movement, regardless of different and independent movements on both sides of the body. The device 10 provides independent, bilateral support proximate the hips of a user, to assist the user in self-propelled, locomotive motion. The device 10 includes an assembled frame 11, four wheels 12, and unloading assemblies 13 and 14 carried on the frame 11. The unloading assemblies 13 and 14 are hidden in FIGS. 1 and 2 by panels 15 carried on the frame 11, but are much more visible in FIGS. 3A and 3B. The unloading assemblies 13 and 14 are coupled to a harness worn by a user, as depicted in FIG. 1, and operate to lift or unload some portion of the user's bodyweight on the left and right sides of the user's body.

The device 10 generally has a top 16, an opposed bottom 17, a front 18, and an opposed back 19. The word "generally" is used here to indicate a general area of the device 10, rather than a specific point, element, feature, or the like. Further, description herein may be made to relative directions or orientations with respect to these terms top, bottom, front, back, and the description may indicate the arrangement of multiple elements or features with respect to each other in the context of above, below, in front of, behind, or the like, relying on the reader's understanding of the top 16, bottom 17, front 18, and back 19 for contextual reference.

The frame 11 includes identical left and right sides 20 and 21 rigidly coupled to each other with a top tube 22 and a bottom tube 23. Because the left and right sides 20 and 21 of the frame 11 are identical, only one is described here, with the understanding that the description applies equally to the other. The same reference characters are used for the structural elements and features of both the left and right sides 20 and 21, and the reader will understand that the context or diction of the relevant description will convey whether the description is of the left or right side 20 or 21.

The right side 21 includes a main tube 24 extending generally diagonally from the bottom 17 and back 19 of the device 10 to the bottom tube 23 of the frame 11 proximate the front 18, approximately midway between the top 16 and bottom 17 of the device 10. The main tube 24 has a rectangular cross-section, is hollow, and has a thin, strong, durable, but lightweight sidewall constructed out of a material or combination of materials having those properties, such as steel, aluminum, titanium, or carbon fiber. Other suitable constructive materials and cross-sections are included within the scope of this description.

The main tube 24 is coupled to a vertical tube or housing 25 which rises from the main tube 24 near the back 19 of the device 10. Though the housing 25 is cylindrical, it is also hollow like the main tube 24. The housing 25 holds part of the unloading assembly, as described later.

A front tube 26 extends diagonally downward, opposite the main tube 24. The front tube 26 has an upper section which is nearly, but not quite, level, a long middle section which is diagonal, and a lower section which is nearly vertical. The top back of the front tube 26 is coupled to the top of the housing 25, and the middle of the front tube 26 is coupled to the front of the main tube 24. The front tube 26, like the main tube 24, preferably but not necessarily has a rectangular cross-section, is hollow, and has a thin, strong, durable, but lightweight sidewall constructed out of a material or combination of materials having those properties, such as steel, aluminum, titanium, or carbon fiber.

The bottoms of the main tube 24 and the front tube 26 are generally vertical. The bottom of the front tube 26 is open so as to receive a post 30. The wheels 12 are mounted on the post 30 for rolling movement and for swiveling movement so that the device 10 can be pointed and moved in a desired direction. A series of vertically spaced-apart holes 31 are formed in the post 30, and an adjustment knob 32 is threaded through the bottom of the front tube 26 and into one of the many holes 31. The knob 32 allows vertical adjustment of the post 30 to change the height of the device 10 at the front 18; the knob 32 may be loosened or released from front tube 26, the post 30 slid up or down, and the knob 32 then tightened or re-engaged with the front tube 26.

The bottom of the main tube 24 has a series of vertically spaced-apart holes 33 formed therethrough; these holes 33 receive an axle 34 of each of the wheels 12 at the back 19 of the device 10. The axle 34 can be moved into any of the holes 33 to adjust the height of the device 10 at the back 19. The axle 34 is secured with a pin 35, such as a cotter pin or other suitable engagement, placed through the axle 34 on the opposite side of the main tube 24 from the wheel 12. The wheels 12 in the back 19 preferably, but not necessarily, are mounted for rolling movement but not for swiveling movement.

The left and right sides 20 and 21 of the frame 11 are coupled by the top tube 22 and the bottom tube 23. The top tube 22 is a rigid tube bent into a U shape, with a straight front section and two side sections or legs oriented at roughly ninety degrees to the front section. These legs are screwed, bolted, welded, or otherwise securely engaged to the top sections of the front tubes 26 on both the left and right sides 20 and 21. Similarly, the bottom tube 23 is a rigid tube bent into a U shape, with a straight front section and two side sections or legs oriented at roughly ninety degrees to the front section. These legs are screwed, bolted, welded, or otherwise securely engaged to top sections of the main tubes 24 on both the left and right sides 20 and 21.

When the user uses the device 10, the user stands, walks, or runs behind the top and bottom tubes 22 and 23 and between the left and right sides 20 and 21, as shown in FIG. 1. As such, the top tube 22, together with the left and right sides 20 and 21 and the bottom tube 23, defines a user-receiving area 36 accessible from the back 19 of the device 10.

A handlebar 40 extends forwardly at the top 16 of the device 10. A cylindrical sleeve 41 is mounted along the top section of the front tube 26; the sleeve 41 is hollow, its back is secured against the top of the housing 25, and its front is open. A series of horizontally spaced-apart holes 42 are formed through the outside of the sleeve 41; an adjustment knob 43 is threaded through the holes 42 and allows horizontal adjustment of the handlebar 40 to change the reach of the user when using the device 10. The knob 43 may be loosened or released from sleeve 41, the handlebar 40 slid into or out of it, and the knob 43 then tightened or re-engaged with the sleeve 41.

The handlebar 40 is curved in several different directions. The back of the handlebar 40 is straight so that it may fit in the sleeve 41. The handlebar 40 has a length, as shown in FIG. 1, so that it extends forwardly beyond the top section of the front tube 26. The handlebar 40 then bends inwardly for a short section, and then bends upwardly for a short section. Other handlebar 40 configurations are suitable as well.

The handlebar 40 is hollow and has a thin, strong, durable, but lightweight sidewall constructed out of a material or combination of materials having those properties, such as steel, aluminum, titanium, or carbon fiber. When a user is disposed in the user-receiving area 36 and operating the device 10, the user can easily reach out and hold the handlebar 40, gripping any portion thereof as is comfortable to steady the device 10 and assist in movement and steering.

Figure 3A:
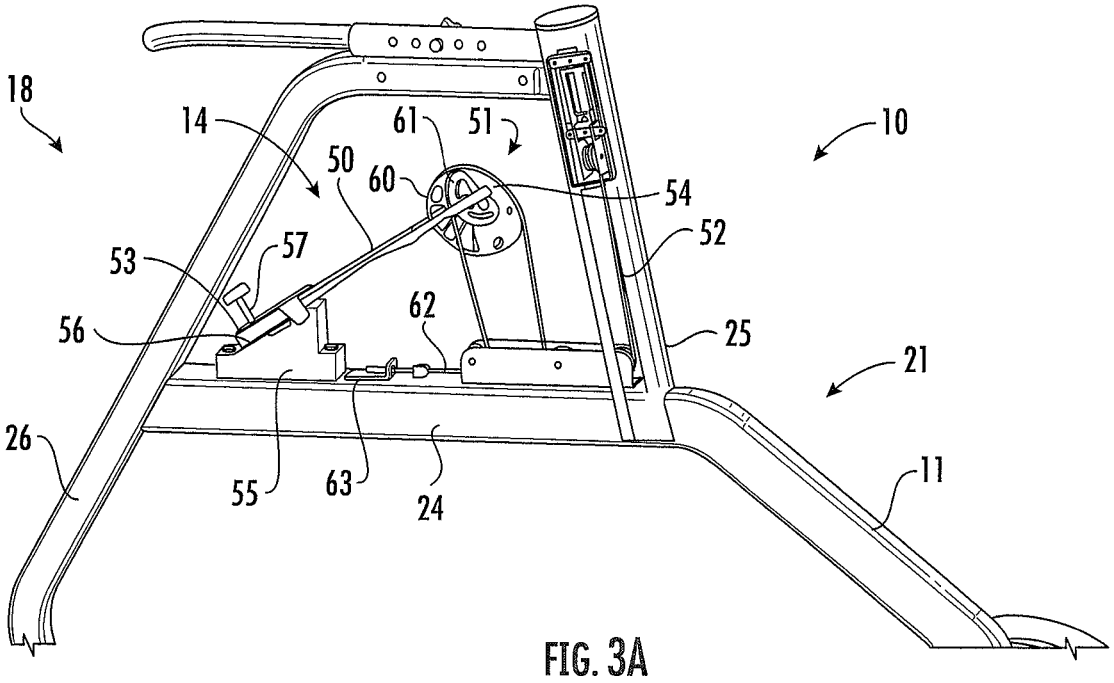
FIG. 3A is an enlarged side elevation view of the bodyweight unloading locomotive device with a panel removed to expose an unloading assembly carried thereon.
Figure 3B:
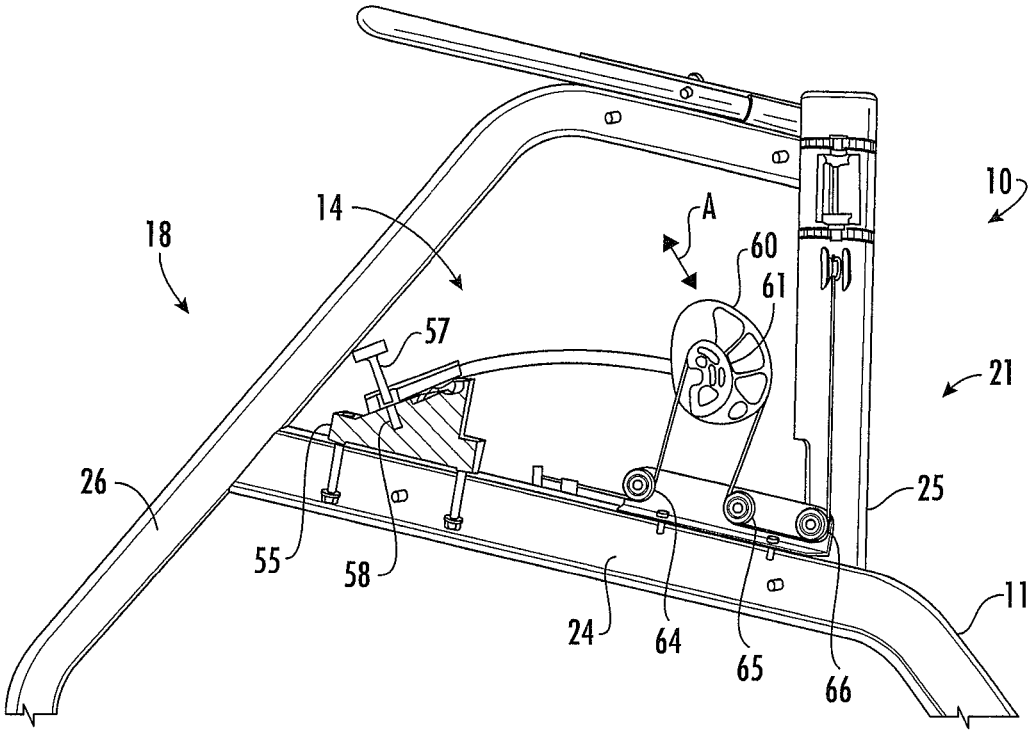
FIG. 3B is a section view taken along the line 3-3 in FIG. 1, slightly sectioning the bodyweight unloading locomotive device and the unloading assembly carried thereon.

FIGS. 3A and 3B show the right side 21 of the frame 11. In FIG. 3A, the panel 15 is removed so that the unloading assembly 14 is visible; FIG. 3B is a section view taken along the line 3-3 of FIG. 1, just barely inside the frame 11, such that the panel 15 is not visible and the frame 11 is partially sectioned. The unloading assemblies 13 and 14 are carried on, and partially within, the frame 11; the unloading assembly 13 is on the left side 20, and the unloading assembly 14 is on the right side 21. Again, as above with respect to the left and right sides 20 and 21, because the unloading assemblies 13 and 14 shown here are identical, only the unloading assembly 14 on the right side 21 will be described here with the understanding that the description applies equally to the other. The same reference characters are applicable to the unloading assembly 14 on the left side 20. However, it should be understood that the unloading assemblies 13 and 14 need not be identical, and this description should not be limited so. Indeed, in some embodiments, it may be desirable to actually have different unloading assemblies. For example, where a user suffers from an asymmetrical weakness, the device 10 may be outfitted with intentionally different unloading assemblies 13 and having different bend, load, and other performance characteristics. For example, for a patient recovering from a stroke, it may be advantageous to provide more unloading force to a side of the patient's body which has been more severely affected by the stroke, while providing less unloading force to the other side. Nevertheless, for the purposes of the description as it relates to the drawings, these particular unloading assemblies 13 and 14 are identical.

The unloading assembly 14 includes a flat spring 50, a stacked cam assembly 51 on the flat spring 50, a cable or tether 52 routed through the stacked cam assembly 51 and a series of pulleys mounted on the frame 11.

The flat spring 50 is a sprung arm: a lightweight, compact, resilient and elongate flat spring member having a first, fixed end 53 and a second, a free end 54. The fixed end 53 is secured in a sleeve mounted on a block 55 having an angled surface 56. An adjustment knob 57 passes through a hole in the fixed end and into a threaded bore 58 in the block 55. The adjustment knob 57 is thus threadably engaged to the block 55 and can be tightened and loosened to change the spring force of the flat spring 50. For less spring force, the adjustment knob 57 is loosened and backed out of the bore 58, which allows the fixed end 53 to rise slightly away from the angled surface 56 of the block 55. For more spring force, the adjustment knob 57 is tightened into the bore 58, which holds the fixed end 53 closer to the angled surface 56 of the block 55. The adjustment knob 57 is a means for adjusting the spring force of the flat spring 50; in other embodiments, the adjustment knob 57 may be an electric, electromechanical or electromagnetic adjustment, or an adjustable bolt, or some other means for changing the spring force.

Indeed, the flat spring 50 operates as a spring. It is mounted in a horizontal configuration. In this horizontal configuration, the free end 54 is above and behind the fixed end 53, and it moves between a first, "unloaded" position as shown in FIG. 3A, in which the free end 54 is in a high position above the fixed end 53, and second, loaded position as shown in FIG. 3B, in which the free end 54 is in a low position closer to the main tube 24. This movement is indicated by the arcuate double-arrowed line A in FIG. 3B. It moves toward the loaded position in response to a weight being placed on the harness on the right side 21, such as by the user walking, and pulling the flat spring 50 down via the tether 52. In response, the flat spring 50 exerts a biasing force in a direction opposite the pull of gravity and vertical translation of the body downward during locomotion; the flat spring acts to pull the tether 52 back. Other horizontal configurations are possible and may be suitable, including configurations which are vertically or horizontally flipped with respect to the above-described configuration. Generally, however, the horizontal configuration is defined as one in which the spring (the spring arm 50, in this case) extends horizontally.

In this way, the flat spring 50 is just a spring which exerts a biasing force in opposition to displacement: extension or compression of a spring. And, in this sense, other springs may be suitable, such as coil springs, pneumatic springs, torsion springs, etc. The flat spring 50 has a non-linear force-displacement curve, such that the force required to displace the flat spring 50 increases as the displacement increases; at larger displacements, a larger force is necessary to displace the free end 54 by the same amount. The flat spring 50 produces a biasing force against its curve, toward the front 18 of the device 10. As such, when the user is moving forward, this forward bias assists in moving the device 10 forward as well.

The stacked cam assembly 51 is mounted for rotation on the free end 54. The stacked cam assembly 51 includes outer and inner cams 60 and 61, placed side-by-side on the free end 54. Both cams 60 and 61 are mounted for rotation with respect to each other about the same axis of rotation, however, the cams 60 and 61 are fixed to each other to prevent relative rotation.

The outer cam 60 is larger, and the inner cam 61 is smaller. Both cams 60 and 61 are eccentrics with different profiles or shapes; their axes of rotation are offset from their respective geometric centers, such that as they rotate, their lever arms change and the ratio of their respective lever arms change. In this way, with the tether 52 wrapped around the outer cam 61 and the tether 62 wrapped around the inner cam 60, in grooves formed therein, the flat spring 50 and cam assembly 51 together form a constant-force displacement system. In other words, beyond a pre-determined pre-loaded displacement, additional displacement does not significantly change the force required for continued displacement. This is described in greater detail below. Further, in other embodiments of the device 10, different cam combinations are used, including assemblies with three or more cams, cams of different sizes than presented here, similarly-sized cams, etc.

Another tether, an inelastic anchor cable 62, is tied between the inner cam 61 and a tie-down 63. This anchor cable 62 is part of the unloading assembly 14. The tie-down 63 is an anchor preventing the end of the anchor cable 62 attached thereto from moving; the other end of the anchor cable 62 is fixed to the inner cam 61. Mounted on top of the main tube 24 is a pulley assembly including three pulleys 64, 65, and 66. One end of the anchor cable 62 is fixed to the top of the front of the inner cam 61 and lays in a groove therein before extending down to the pulley 64. With rotation of the inner cam 61, the anchor cable 62 wraps around the circumference of the inner cam 61 and effectively shortens the anchor cable 62, bending the flat spring 50 toward the loaded position. The length of the anchor cable 62 can be adjusted at the tie-down 63 to increase or decrease the pre-load on the flat spring 50.

The tether 52 has an opposite orientation on the larger outer cam 60. It has two ends. One end of the tether 52 is fixed to front side of the cam 60; this end is wrapped over the top of the cam 60 but in a different direction from the anchor cable 62, such that it is fixed to the front side of the cam 60 and then extends over and around the circumference of the cam 60. From there, the tether 52 extends downward to the pulleys 65 and 66. The pulley 66 is partially mounted inside the housing 25. As the tether 52 routes under the pulley 65, it is redirected from a roughly vertical direction to a roughly horizontal one, and as the tether 52 routes under the pulley 66, it is redirected from that roughly horizontal direction to a roughly vertical one inside the hollow housing 25.

The three pulleys 64, 65, and 66 have parallel axes; each spins in the same direction. All three pulleys 64, 65, and 66 are mounted proximate each other, along the main tube 24, and in the same plane, such that they only act to redirect the anchor cable 62 or tether 52 in a new direction along that plane. However, the tether 52 rises up from the pulley 66 inside the housing 25 to a different set of pulleys which orient the tether 52 for attachment to the harness.

Figure 4A:
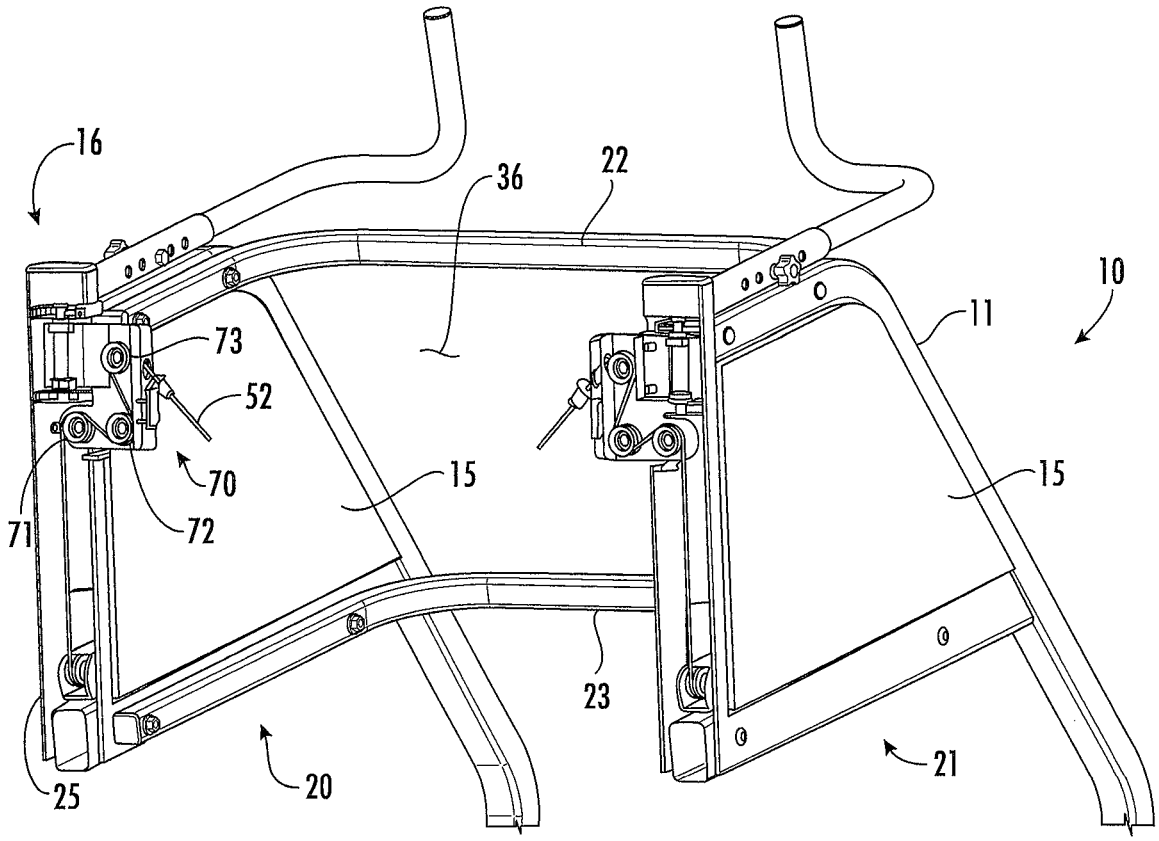
FIG. 4A is a section view taken along the line 4-4 in FIG. 2, showing pulley cassettes on the bodyweight unloading locomotive device.
Figure 4B:
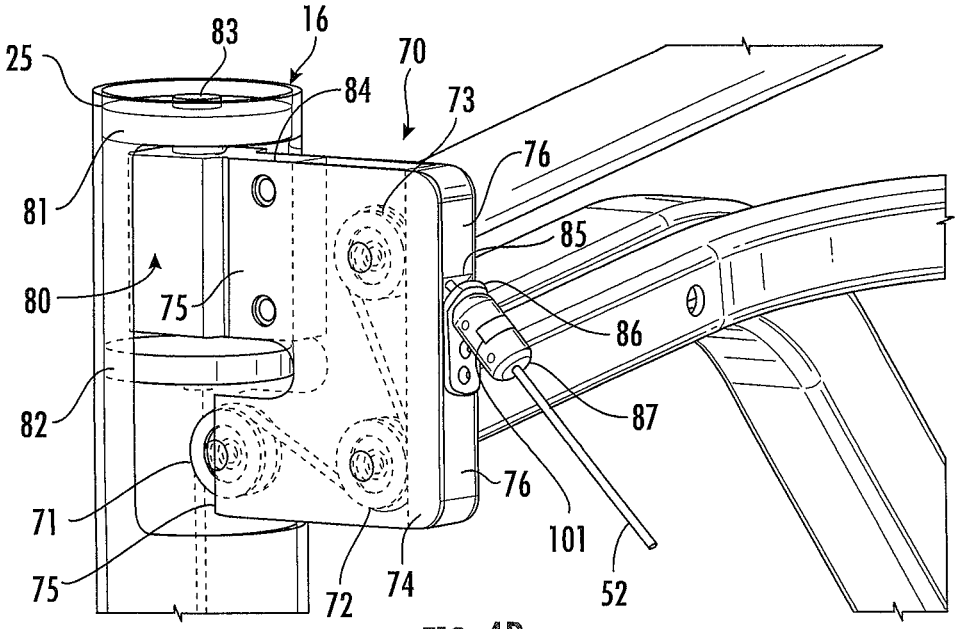
FIGS. 4B and 4C are enlarged rear perspective views of one of the pulley cassettes.
Figure 4C:
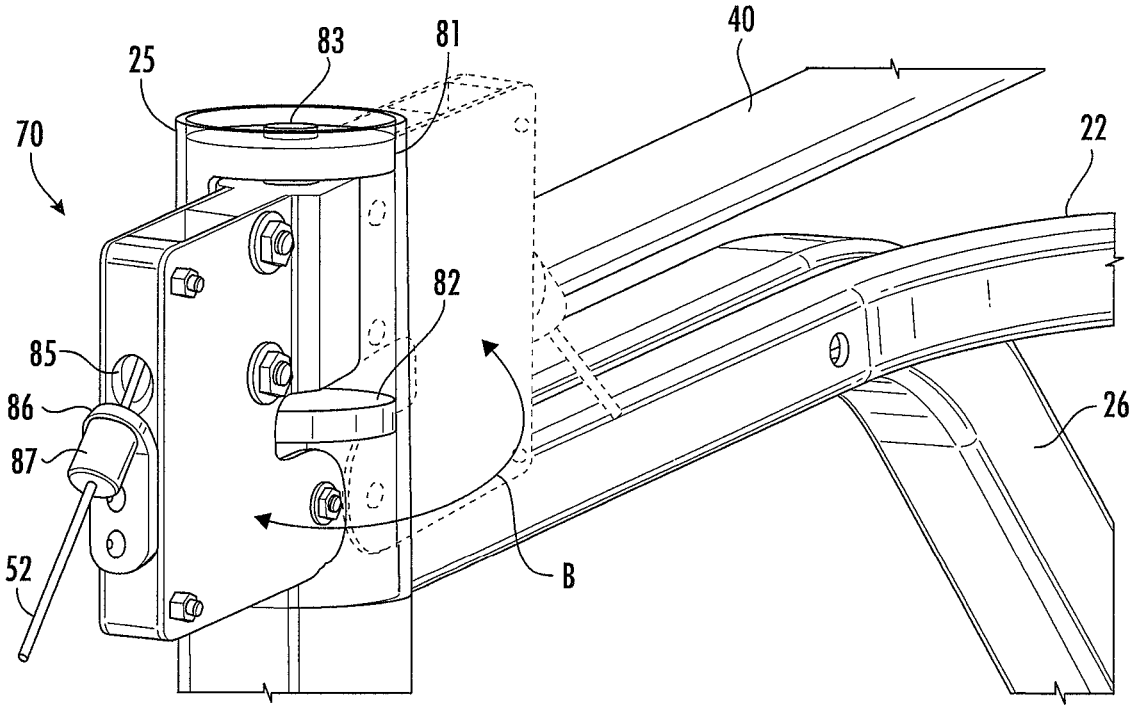

FIGS. 4A-4C illustrate a pulley cassette 70 containing these other pulleys 71, 72, and 73 which redirect the tether 52. The pulley cassette 70 is part of the unloading assembly 13 (or 14) and is mounted for swinging movement in the housing 25 of the frame 11 and includes an outer housing 74 with an inner side 75 and an opposed outer side 76. The outer side 76 is directed away from the frame 11, inward into the user receiving area 36. The inner side 75 is partially carried within the housing 25. Proximate the top 16, the housing 25 has a large open window 80. The pulley cassette 70 swings forward and backward in this window 80. Two discs 81 and 82 are secured within the housing 25; the disc 81 is proximate the top 16, and the disc 82 is just slightly lower. Extending coaxially between the discs 81 and 82 is a pin 83. Fixed to the inner side 75 of the pulley cassette 70 is a leaf with a knuckle 84. The knuckle 84 has a vertical bore which is loosely mounted over the pin 83. Thus, the knuckle 84 pivots on the pin 83, and the pulley cassette 70 swings with the knuckle between a forward position (shown in broken line in FIG. 4C) and a rearward position (shown in solid line) along the double-arrowed arcuate line B in FIG. 4C. FIG. 4C shows a wide range of angular movement, but preferably the pulley cassette is limited in swinging more than thirty degrees in front of or behind a neutral position, which is shown in FIGS. 4A and 4B.

Within the housing 74 are three axles on which the pulleys 71, 72, and 73 are mounted for rolling movement. When the pulley cassette 70 is in the neutral position of FIGS. 4A and 4B, these pulleys 71, 72, and 73 are mounted in a perpendicular offset fashion to the pulleys 64, 65, and 66. The tether 52 extends up from the pulley 66, inside the housing 25, and routes over the first pulley 71, then under the second pulley 72, and then again over the third pulley 73. A hole 85 is formed through the outer side 76 of the housing 74, and a strong bracket mounted outside the hole 85 has a hole corresponding thereto. A stop 87 is secured on the tether 52 to prevent the tether 52 from being pulled into the pulley cassette 70 farther than desired.

In operation, a user uses the device 10 to assist in locomotive movement. The device 10 is useful for physical therapy, rehabilitation, and athletic training. Returning to FIG. 1, a user 90 is illustrated in the user-receiving area 36 using the device 10. The user is wearing a harness 91. Any suitable harness 91 may be used; this harness 91 includes an adjustable waist belt 92, adjustable thigh straps 93, adjustable above-the-knee straps 94, and outer or lateral straps 95 on each side of the harness 91 inelastically connecting the waist belt 92, thigh strap 93, and above-the-knee strap 94. In FIG. 1, the tethers 52 from both unloading assemblies 13 and 14 are shown directly attached to the waist belt 92. Attachment of the tethers 52 to a point at the level of the region between the hip joint and the waist is preferred. In other embodiments, the tethers 52 may terminate with clips such as carabiners for coupling to loops on the waist belt 92. The tethers 52 are attached to opposing sides of the waist belt 92, just above the hip joints. In this way, each tether 52 independently acts on one respective side of the body.

The harness 91 couples the user 90 to the device 10. When the user 90 walks, his hips move up and down. In normal locomotion, when the left leg is moved forward, his left hip rises slightly and his right hip drops slightly, and his pelvis rotates to a small degree. When it does, on the left side 20, the cassette pulley 70 swings forward slightly, the tether 52 retracts (until limited by the stop 87 encountering the bracket 86), and the flat spring 50 bends to a lesser degree toward its unloaded position. The force exerted by the flat spring 50 is in the forward direction, which assists in moving the device 10 forward slightly. At the same time, on the right side 21, the cassette pulley 70 swings backward slightly, and the tether 52 extends to accommodate the dropping of the right hip and rotation of the pelvis. This pulls the tether 52 through the pulley cassette 70 and through the pulleys 64, 65, and 66, thereby causing the cam assembly 51 to rotate and the flat spring 50 to bend to a greater degree. The left and right side 20 and 21 flat springs 50 independently exert a bias on the tethers 52 on their respective sides; in response, the user 90 feels his weight on both the right and left sides of this body at least partially unloaded. Further, because the unloading assemblies 13 and 14 each independently are a constant-force displacement system, rather than a simple spring force or exponential force displacement system, the user 90 experiences a constant or consistent unloading despite the extent of the displacement on either side. In other words, whether the user 90 raises his right hip or drops his right hip a little or a lot, the unloading force he experiences is constant. In yet other words, if the user drops his right hip a significant distance, he does not experience a proportionally greater unloading. For example, the device 10 can be set up to provide a constant fifty pounds of unloading force. If the user drops his hip a little, he will feel that fifty pounds of unloading; if the user drops his hip a lot, he will still feel that same fifty pounds of unloading.

Moreover, the sides of his body move independently—and are allowed to move independently—because the unloading assemblies 13 and 14 are independent of each other. In more detailed operation, when the hip of the user 90 moves a distance, the tether 52 moves this distance as well, and unwinds from the cam 60. The anchor cable 62 spools onto the cam 61, shortening its effective length and causing the flat spring 50 to flex. The cam assembly 51 unreels and the flat spring 50 bends to a greater degree. Because the flat spring 50 and cam assembly 51 combine to form a constant-force displacement, however, the patient feels a constant upward unloading force on that side of the harness 91. The displacement of the tether 52—whether it is one inch or six inches—does not cause a proportional change in the upward force. Rather, the displacement causes essentially no change in unloading force. In this way, the device 10 provides a constant unloading of each side of the user's body, independently of each other.

In other embodiments, a sensor 100 proximate one of the wheels 12 measures rolled distance. A sensor 101 in the stop 87, or in the pulley cassette 70, or somewhere along the tether 52, measures acceleration and thus force, and possibly also angle of incline. The sensors 100 and 101 each may include a microprocessor, gyroscope, accelerometer, memory chip, PCB, and like electronic components. The readings from these two sensors 100 and 101 are correlated for later analytics; doctors and physical therapists can use this information to determine stride length, stance and swing phase duration, speed, work energy, and other kinematic and kinetic parameters of locomotion, and this information can be compared for each side of the body as well as over time to evaluate rehabilitation. Moreover, in some embodiments, these sensors 100 and 101 are coupled in wired or wireless data communication to a display head unit, such as a smartphone or other electronic device, preferably mounted on the top tube 22, which displays such information to the user 90. The user 90 can toggle through this and other information by depressing a physical button or touching the display of the head unit.

In some instances, the wheels of the device 10 may be removed. This removes the mobility of the device 10, but it can instead now be placed on or around a treadmill. The bottom 17 of the frame may be bolted onto or otherwise secured to the treadmill using the holes 31 and 33. Alternatively, pads or cushions applied to the bottom 17 of the frame 11 can support the device 10 around the treadmill. The user can then walk or run on the treadmill with his weight supported as described above.

Figure 5:
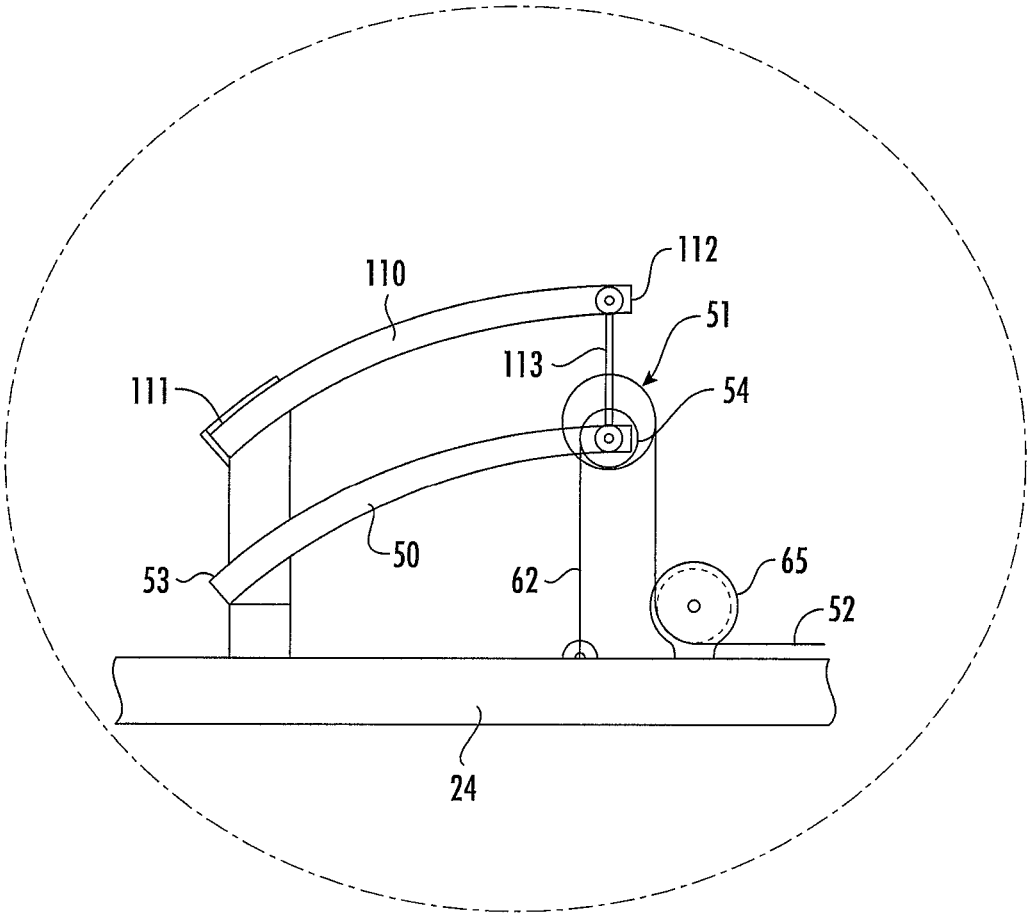
FIGS. 5-7 are enlarged, generalized diagrams illustrating alternative embodiments of the unloading assembly.

FIG. 5 shows an alternate embodiment of the unloading assembly 13 of the device 10. The below description applies equally to an alternate embodiment of the unloading assembly 14. In this embodiment, two flat springs are used in combination. FIG. 5 is stylized in the form of a free body diagram, but a reader understanding the description hereto will nonetheless readily appreciate and understand FIG. 5.

The flat spring 50 is mounted as in FIG. 3A: the fixed end 53 is fixed to the main tube 24 and the free end 54 is free. The cam assembly 51 is mounted for rotation to the free end 54, and the anchor cable 62 is fixed while the tether 52 routes around the pulley 65 to extend to the harness. However, in this embodiment, a second flat spring 110 is used. The flat spring 110 is also a sprung arm preferably, but not necessarily, identical in structure, features, and construction to the flat spring 50; it also includes a fixed end 111 and a free end 112. The flat spring 110 is mounted in a parallel fashion to the flat spring 50. As the term is used here, "parallel" is analogous to two elements in an electrical circuit and does not necessarily refer to a geometric relationship or alignment between the two flat springs 50 and 110. Specifically, the flat spring 50 and cam assembly 51 are in a first position, and the second flat spring 110 is carried in a second position; the first and second positions are different but are registered with each other in a vertically offset fashion. The flat springs 50 and 110 in this embodiment are coextensive, but they need not be.

The second flat spring 110 is stacked above the flat spring 50. A rigid, inelastic cable 113 ties or couples the free end 112 of the flat spring 110 to the free end 54 of the flat spring 50, such that movement of the free end 54 immediately and directly imparts movement to the free end 112. This coupled arrangement increases the spring force of the flat spring 50. The tether 52 remains wrapped around the cam assembly 51 on the flat spring 50. Stacking flat springs on the frame 11 in this way allows the device 10 to unload more weight from the user during operation. In other embodiments, three or more flat springs could be stacked, though this would not likely be necessary for all but the most demanding of weight needs.

Figure 6:
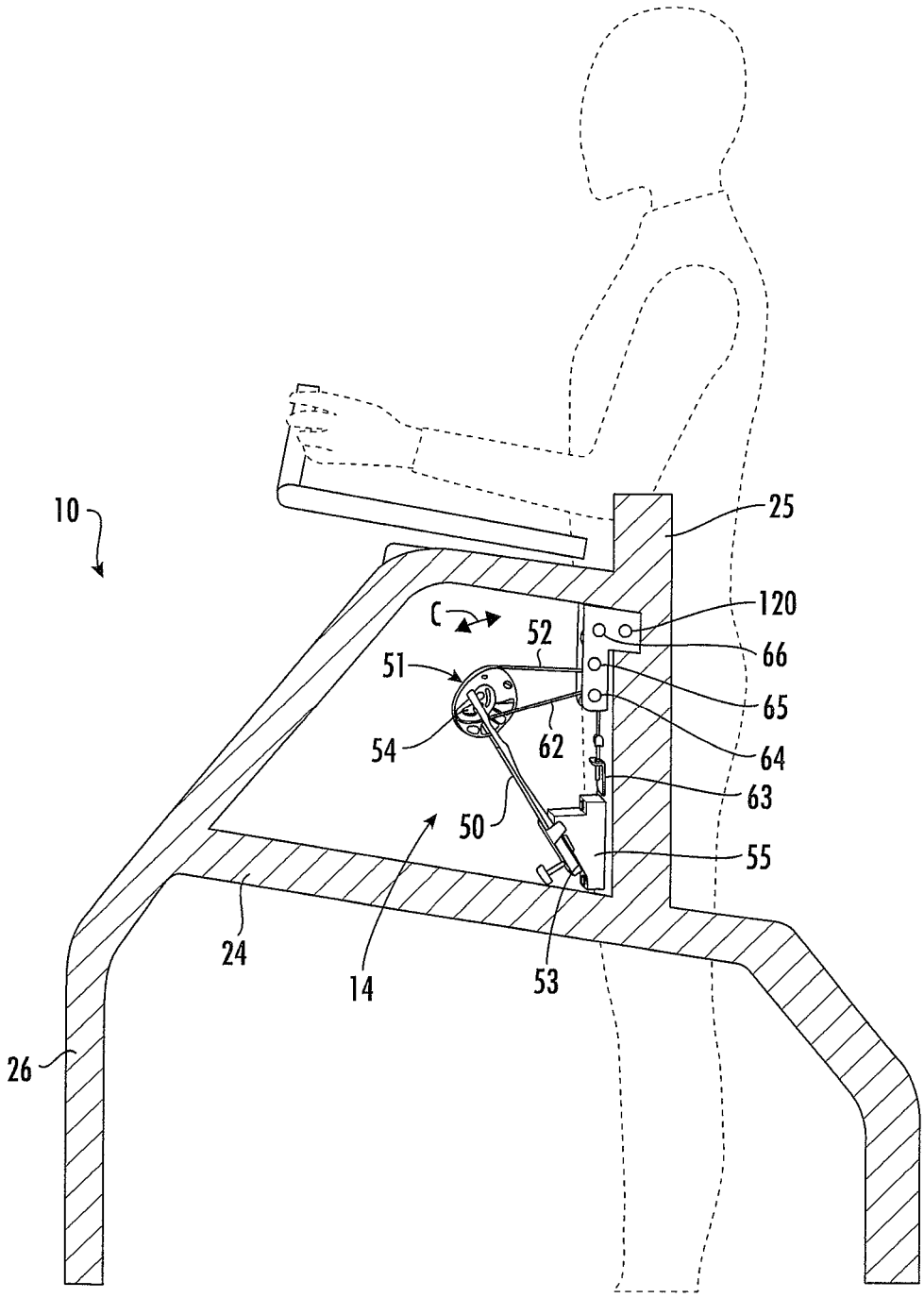

FIG. 6 shows another alternate embodiment of the device 10. While the unloading assembly 14 in FIGS. 3A and 3B is mounted in a horizontal configuration in which the flat spring 50 extends rearwardly in a general direction and its free end 54 is behind its fixed end 53, here in FIG. 6, the unloading assembly 14 is mounted in a vertical configuration. This unloading assembly 14 is mounted on the vertical housing 25 rather than the horizontal top of the main tube 24. The flat spring 50 is still mounted to the block 55, but the block 55 is fixed vertically on the housing 25, such that the flat spring 50 extends upward, rather than rearward. The free end 54 of the flat spring 50 is above the fixed end 53, and when the flat spring 50 flexes, the free end 54 is displaced rearwardly toward the housing 25. The flat spring 50 produces a biasing force against its curve, toward the front 18 of the device 10. As such, when the user is moving forward, this forward bias assists in moving the device 10 forward as well. FIG. 6 shows in solid line the unloading assembly 14 in an unloaded position, and the unloading assembly 14 moves along the double-arrowed arcuate line C toward the housing to a loaded position, similar in displacement to the loaded position shown for the horizontal configuration of FIG. 3B. Other vertical configurations are possible and may be suitable, including configurations which are vertically or horizontally flipped with respect to the above-described configuration. Generally, however, the vertical configuration is defined as one in which the spring (the spring arm 50, in this case) extends vertically. The pulleys 64, 65, and 66 are also moved to a vertical arrangement, but the anchor cable 62 still routes through the pulley 64 and is secured to the tie-down 63, which is on the housing 25. The tether 52 also still routes through the pulleys 65 and 66 but now also extends through an additional pulley 120 which redirects the tether 52 upwardly through the housing to the pulley cassette 70.

Figure 7:
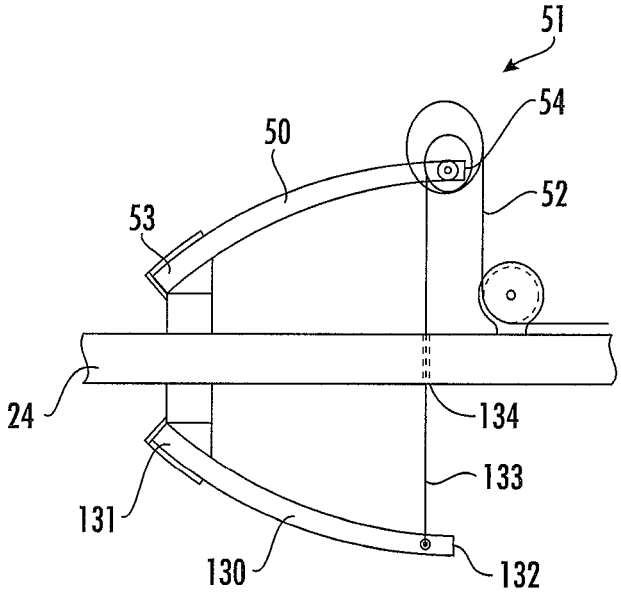

FIG. 7 shows yet another alternate embodiment of the unloading assembly 13 of the device 10, somewhat similar to that shown in FIG. 5. The below description applies equally to an alternate embodiment of the unloading assembly 14. In this embodiment, two flat springs are used in combination. FIG. 7 is stylized in the form of a free body diagram, but a reader understanding the description hereto will readily appreciate and understand FIG. 7.

The flat spring 50 is mounted as in FIG. 3A: the fixed end 53 is fixed to the main tube 24 and the free end 54 is free. The cam assembly 51 is mounted for rotation to the free end 54, and the anchor cable 62 is fixed while the tether 52 routes around the pulley 65 to extend to the harness. However, in this embodiment, a second flat spring 130 is used. The flat spring 130 is also a sprung arm and is preferably, but not necessarily, identical in structure, features, and construction to the flat spring 50; it also includes a fixed end 131 and a free end 132. The flat spring 130 is mounted in a parallel fashion to the flat spring 50, however, it is mounted below the main tube 24, or opposite the flat spring 50. As the term is used here, "parallel" is analogous to two elements in an electrical circuit and does not refer to a geometric relationship or alignment between the two flat springs 50 and 130. Specifically, the flat spring 50 and cam assembly 51 are in a first position, and the second flat spring 130 is carried in a second position; the first and second positions are different but are registered with each other in a vertically offset fashion. The flat springs 50 and 130 in this embodiment are coextensive, but they need not be.

The second flat spring 130 is stacked below the flat spring 50 and has an inverted position: while the flat spring flexes downwardly under a load, the second flat spring 130 flexes upwardly. An inelastic cable 133 couples the free end 132 of the flat spring 130 to the inner cam 61 at the free end 54 of the flat spring 50, such that rotation of the inner cam 61 directly imparts upward movement of the free end 132 of the flat spring 130 as well as downward movement of the free end 54 of the flat spring 50. The cable 133 passes through a bore 134 in the main tube 24. This coupled arrangement increases the spring force of the unloading assembly beyond that of the unloading assembly 13 or 14. The tether 52 remains wrapped around the outer cam 60 of the cam assembly 51 on the flat spring 50. Coupling flat springs on the frame 11 in this way allows the device 10 to unload more weight from the user during operation. In other embodiments, three or more flat springs could be stacked on either side of the main tube 24 and coupled together, though this would not likely be necessary in all but the most demanding of weight needs.

In some embodiments, the cam assembly 51 need not be mounted directly onto the flat spring 50, or, in other words, the cam assembly 51 can be separate from the spring. For example, the flat spring 50 of FIG. 7 could be modified to be a rigid, inflexible, unyielding arm 50. In this embodiment, the cam assembly 51 is simply mounted to an arm 50, similar to a rigid post, above the main tube 24. The arm 50 is thus simply considered part of the frame 11, or a rigid extension thereof. The cam assembly 51 is thus coupled to the second or free end 132 of the bendable flat spring 130 with the inelastic cable 133, and to the harness with the tether 52. The flat spring 130 is the only arm that moves in this arrangement; when the harness drops, the tether 52 pulls on and rotates the cam assembly 51, and the cable between the cam assembly 51 and the flat spring 130 pulls on and bends the flat spring 130. This embodiment is exemplary of unloading assemblies in which the cam assembly and the flat spring are separate, illustrating that the cam assembly need not be carried on or mounted to the flat spring. Indeed, the unloading assembly still operates effectively as a constant-force displacement system when the cable 133 (or anchor cable 62) couples the cam assembly in one direction to a spring (such as the flat spring 130) and the tether 52 couples the cam assembly in an opposing direction to the harness, regardless of the mounting of the cam assembly on or off the spring. This alternate version of FIG. 7 describes such an arrangement in an exemplary fashion. In other embodiments, the spring arm and cam assembly may be separated and not mounted to each other, and the arrangement of the cam assembly and spring arm are actually reversed: the cam assembly 51 is mounted on the main tube 24, the spring arm 50 is mounted on the main tube 24 apart from the cam assembly 51 extends away, an anchor cable 62 coupled to a tie-down 63 extends to the cam assembly 51, and then a tether 52 extends from the cam assembly 51 to over the free end 54 of the flat spring 50 and then toward the harness (likely through a pulley assembly).

A preferred embodiment is fully and clearly described above so as to enable one having skill in the art to understand, make, and use the same. Those skilled in the art will recognize that modifications may be made to the description above without departing from the spirit of the specification, and that some embodiments include only those elements and features described, or a subset thereof. To the extent that modifications do not depart from the spirit of the specification, they are intended to be included within the scope thereof.

What is claimed is:

1. A bodyweight unloading locomotive device comprising:
   - a frame mounted on wheels for supporting locomotive movement, the frame having opposed left and right sides;
   - a harness for supporting a user between the left and right sides;
   - an unloading assembly carried on each of the left and right sides, wherein each unloading assembly comprises:
     - a sprung arm having a fixed end fixed to the respective left and right side, and an opposed free end;
     - a cam assembly mounted on the free end of the sprung arm; and
     - a tether routed through the cam assembly and extending to the harness;
   - wherein each of the unloading assemblies exerts an independent unloading force on the harness with respect to the frame.

2. The bodyweight unloading locomotive device of claim 1, wherein the sprung arm comprises a flat spring.

3. The bodyweight unloading locomotive device of claim 1, wherein the cam assembly comprises first and second cams of different sizes.

4. The bodyweight unloading locomotive device of claim 3, wherein the tether is fixed to the first cam and extends to the harness, and a cable is fixed, at one end, to the second cam and, at an opposed end, to an anchor on the frame.

5. The bodyweight unloading locomotive device of claim 3, wherein the first and second cams are fixed to each other to prevent relative rotational movement with respect to each other.

6. The bodyweight unloading locomotive device of claim 1, wherein the fixed end of the sprung arm is held at an adjustment means, and adjustment of the adjustment means changes the unloading force exerted by the respective unloading assembly.

7. The bodyweight unloading locomotive device of claim 1, wherein the sprung arm is mounted in the respective left and right side of the frame in a horizontal configuration in which the free end of the sprung arm is behind the fixed end, and the free end moves vertically between a first, unloaded position and a second, loaded position.

8. The bodyweight unloading locomotive device of claim 1, wherein the sprung arm is mounted in the respective left and right side of the frame in a vertical configuration in which the free end of the sprung arm is above the fixed end, and the free end moves horizontally between a first, unloaded position and a second, loaded position.

9. The bodyweight unloading locomotive device of claim 1, wherein the unloading assembly comprises:

the sprung arm and cam assembly in a first position; and a second sprung arm carried in a second position vertically offset from the first position, wherein the second sprung arm has a free end tied to the cam assembly.

10. The bodyweight unloading locomotive device of claim 1, further comprising a pulley cassette which routes the tether from an upward direction to an inward and downward direction to the harness.

11. The bodyweight unloading locomotive device of claim 10, wherein the pulley cassette is mounted for swinging movement in the frame.

12. A bodyweight unloading locomotive device comprising:

a frame for supporting locomotive movement, the frame having opposed left and right sides;

a harness for supporting a user between the left and right sides;

an unloading assembly carried on each of the left and right sides, wherein each unloading assembly comprises:

a spring having a first end fixed to the respective left and right side, and an opposed second end;

a cam assembly;

a tether routed through the cam assembly and extending to the harness; and a cable routed through the cam assembly and extending to one of an anchor on the frame and the second end of the spring;

wherein each of the unloading assemblies exerts an independent unloading force on the harness with respect to the frame.

13. The bodyweight unloading locomotive device of claim 12, wherein the spring is a sprung arm.

14. The bodyweight unloading locomotive device of claim 12, wherein the first end of the spring is held at an adjustment means, and adjustment of the adjustment means changes the unloading force exerted by the respective unloading assembly.

15. The bodyweight unloading locomotive device of claim 12, wherein the spring is mounted in the respective left and right side of the frame in a horizontal configuration.

16. The bodyweight unloading locomotive device of claim 12, wherein the spring is mounted in the respective left and right side of the frame in a vertical configuration.

17. The bodyweight unloading locomotive device of claim 12, further comprising a pulley cassette which routes the tether from an upward direction to an inward and downward direction to the harness.

18. The bodyweight unloading locomotive device of claim 17, wherein the pulley cassette is mounted for swinging movement in the frame.

19. The bodyweight unloading locomotive device of claim 12, wherein the cam assembly comprises first and second cams of different sizes.

20. The bodyweight unloading locomotive device of claim 19, wherein the first and second cams are fixed to each other to prevent relative rotational movement with respect to each other.

* * * * *